US008640421B2

(12) United States Patent
Frobosilo

(10) Patent No.: US 8,640,421 B2
(45) Date of Patent: Feb. 4, 2014

(54) WALL SYSTEM WITH SELF GAUGING TROWEL ON MEMBRANE

(75) Inventor: Edward Frobosilo, Edison, NJ (US)

(73) Assignee: Energex LLC, Edison, NJ (US)

( * ) Notice: Subject to any disclaimer, the term of this patent is extended or adjusted under 35 U.S.C. 154(b) by 0 days.

(21) Appl. No.: 13/431,266

(22) Filed: Mar. 27, 2012

(65) Prior Publication Data

US 2013/0255179 A1 Oct. 3, 2013

(51) Int. Cl.
*E04G 21/10* (2006.01)

(52) U.S. Cl.
USPC ..... 52/741.41; 52/169.14; 52/446

(58) Field of Classification Search
USPC ..... 52/169.14, 169.5, 417, 443, 445, 446, 52/449, 453, 454, 741.4, 741.41, 746.1
See application file for complete search history.

(56) References Cited

U.S. PATENT DOCUMENTS

| | | | | |
|---|---|---|---|---|
| 3,284,980 | A * | 11/1966 | Dinkel | 52/600 |
| 3,386,223 | A | 6/1968 | Wegwerth | |
| 3,445,322 | A * | 5/1969 | Saiia et al. | 428/178 |
| 3,576,091 | A * | 4/1971 | Shull et al. | 52/309.3 |
| 4,388,424 | A | 6/1983 | Kennell et al. | |
| 4,441,944 | A | 4/1984 | Massey | |
| 5,979,131 | A * | 11/1999 | Remmele et al. | 52/309.9 |
| 6,016,635 | A | 1/2000 | Shaw et al. | |
| 6,355,333 | B1 * | 3/2002 | Waggoner et al. | 428/174 |
| 6,901,712 | B2 | 6/2005 | Lionel | |
| 7,241,828 | B2 | 7/2007 | Kyte et al. | |
| 7,265,166 | B2 | 9/2007 | Gebhard et al. | |
| 7,836,652 | B2 * | 11/2010 | Futterman | 52/417 |
| 8,112,966 | B2 | 2/2012 | Bowe et al. | |
| 2002/0108333 | A1 * | 8/2002 | Clayton | 52/302.1 |
| 2005/0197444 | A1 | 9/2005 | Kyte et al. | |
| 2006/0277854 | A1 | 12/2006 | Egan | |
| 2007/0249778 | A1 | 10/2007 | Clemens et al. | |
| 2009/0107611 | A1 | 4/2009 | Bowe et al. | |
| 2011/0258944 | A1 | 10/2011 | Radoane | |
| 2011/0283917 | A1 | 11/2011 | Garuti, Jr. et al. | |

FOREIGN PATENT DOCUMENTS

| | | |
|---|---|---|
| GB | 883521 | 11/1961 |
| GB | 951953 | 3/1964 |
| GB | 1171131 | 11/1969 |
| GB | 1486232 | 9/1977 |

(Continued)

OTHER PUBLICATIONS

Aexcel Inc., Aexcel "MMA Traffic Paint", http://www.aexcelcorp.com/content.asp?PageId=48, Mar. 6, 2012.

(Continued)

*Primary Examiner* — Brian Glessner
*Assistant Examiner* — James Buckle, Jr.
(74) *Attorney, Agent, or Firm* — Notaro, Michalos & Zaccaria P.C.

(57) ABSTRACT

Method for creating a liquid barrier on building sheathing, provides a polymer mixture with beads of uniform diameter, affixes mesh across joints in the sheathing and trowels the mixture onto the sheathing using a straight edge. The straight edge rolls over the beads and leaves the mixture between the beads for creating a layer have a uniform thickness. Before the layer sets, peaks of an inner corrugated surface of an insulation board are pressed into the layer for adhering the board to the sheathing, the inner surface having valleys between the peaks at a distance greater then twice the diameter of the beads. The layer sets to create the liquid barrier and for fixing the board to the sheathing with spaces left between the barrier and the valleys for water runoff across the sheathing.

18 Claims, 1 Drawing Sheet

(56) References Cited

FOREIGN PATENT DOCUMENTS

| | | |
|---|---|---|
| JP | 60004567 | 1/1985 |
| JP | 5272212 | 10/1993 |
| JP | 201106979 | 4/2001 |
| JP | 2007146605 | 6/2007 |
| WO | WO 2011042255 | 4/2011 |

OTHER PUBLICATIONS

Bostik, Dimension-Reflective, Pre-Mixed Urethane Grout, http://www.bostik-us.comsites/default/files/Dimension.pdf, Mar. 6, 2012.

* cited by examiner

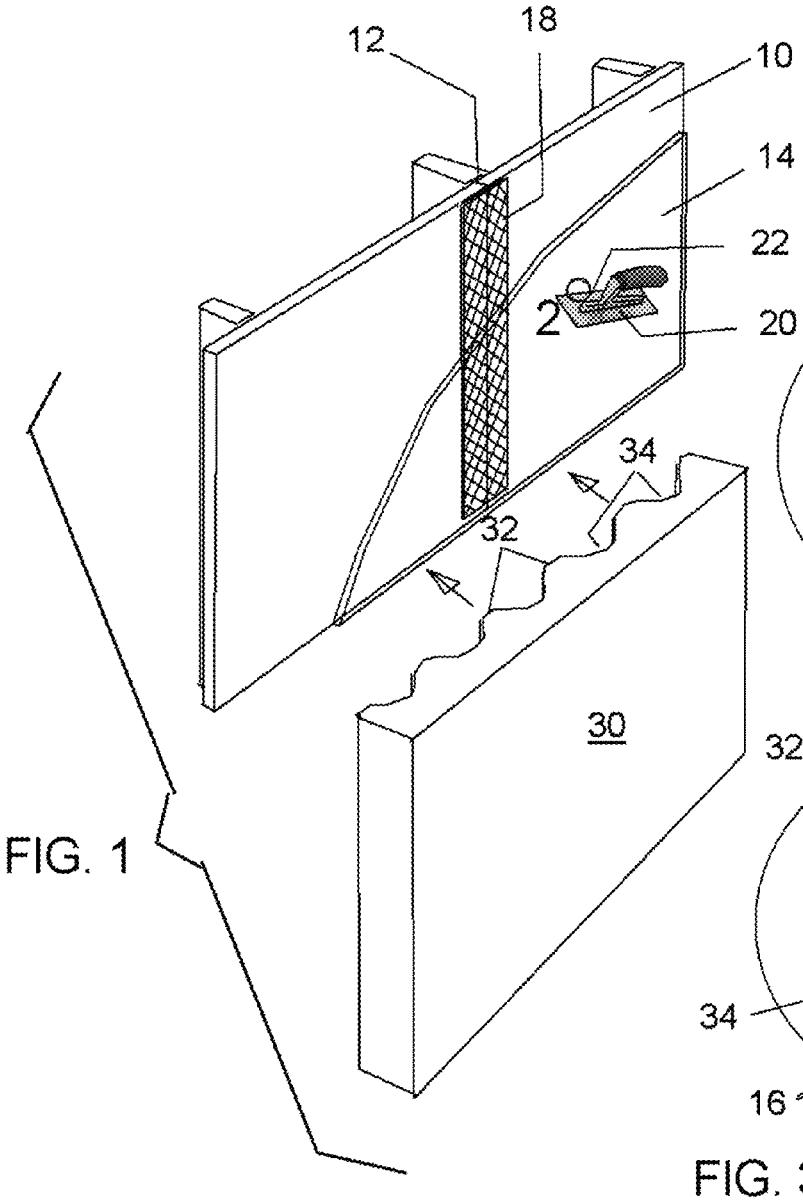
FIG. 1
FIG. 2
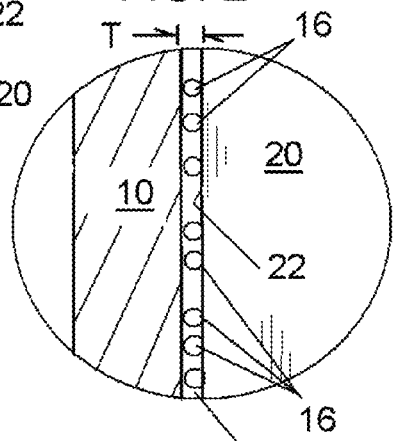
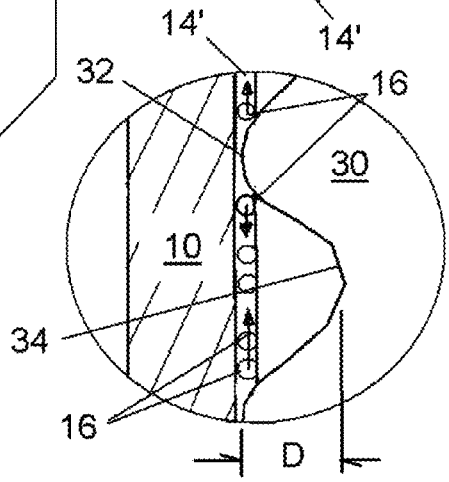
FIG. 3

WALL SYSTEM WITH SELF GAUGING TROWEL ON MEMBRANE

FIELD AND BACKGROUND OF THE INVENTION

The present invention relates generally to the field of exterior building treatment and in particular to a new and useful wall system method and arrangement that includes a self gauging, trowel on liquid barrier membrane.

SUMMARY OF THE INVENTION

It is an object of the present invention to provide a method for creating a liquid barrier with insulation on a building sheathing comprising: providing a polymer mixture containing a dispersion of rigid beads of uniform diameter; affixing a mesh across joints in the sheathing; troweling the mixture onto the sheathing using a straight edge of a trowel, the straight edge rolling over beads in the mixture for leaving mixture between the beads to create a layer having a uniform thickness substantially equal to the diameter of the beads on the sheathing; and, before the layer sets, pressing peaks of an inner corrugated surface of an insulation board into the layer for adhering the board to the sheathing, the inner surface having valleys between the peaks at a distance from the peaks that is greater then twice the diameter of the beads; the layer setting to create the liquid barrier and for fixing the board to the sheathing with spaces left between the barrier and the valleys for water runoff across the sheathing.

Another object of the invention is to provide a wall system method for creating a liquid barrier with insulation over an area of building sheathing having at least one joint, comprising: providing a supply of fluid caulking polymer mixture containing a dispersion of spherical, rigid, non-reactive beads of substantially uniform diameter, the diameter being selected to correspond to the thickness of a liquid barrier to be applied to the area of building sheathing; affixing a mesh across each joint in the area of building sheathing; troweling the fluid caulking polymer mixture onto the area of building sheathing using a straight edge of a trowel to apply a layer of the fluid mixture onto the area, the straight edge of the trowel rolling over the rigid beads and leaving fluid mixture between the beads for creating the layer having a substantially uniform thickness on the building sheathing that is substantially equal to the diameter of the beads; before the layer of fluid mixture that has been applied to the area of building sheathing has set, pressing peak portions of an inner surface of an expanded foam insulation board into the layer for adhering the board to the area of building sheathing, the inner surface of the expanded foam insulation board having valleys between the peaks with a distance between the peaks and valleys being greater then twice the diameter of the beads; and allowing the layer of fluid mixture to set to create the liquid barrier and for fixing the board to the area of building sheathing with spaces being left between the liquid barrier and the valleys for water runoff across the area of building sheathing.

An further object of the invention is to press the peak portions of the inner surface of the expanded foam insulation board into the layer sufficiently to push a plurality of the beads aside so that the peak portions are closer to the building sheathing then the diameter of the beads to better adhere the board to the sheathing. In this case the distance between the peaks and valleys is greater then twice the diameter of the beads.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is an exploded view of the components for practicing the present invention;

FIG. 2 is an enlarge detail from the area marked 2 in FIG. 1, in horizontal section; and FIG. 3 is an enlarge detail of the wall system of FIG. 1 after it has been completed, in horizontal section.

DESCRIPTION OF THE PREFERRED EMBODIMENTS

Referring now to the drawings, in which like reference numerals are used to refer to the same or similar elements, FIG. 1 shows a wall system method for creating a liquid barrier with insulation over an area of building sheathing 10 having at least one joint 12, comprising providing a supply of fluid caulking polymer mixture 14 containing a dispersion of spherical, rigid, non-reactive beads 16, such as but not limited to glass beads, of substantially uniform diameter (T equal to about 1.5 mm for example), the diameter being selected to correspond to the thickness (T) of a liquid barrier to be applied to the area of building sheathing.

A mesh 18, e.g. a fiberglass joint mesh of known design, is applied across each joint 12 in the area of building sheathing 10, by using some of the mixture 14 as adhesive for the mesh 18.

The fluid caulking polymer mixture 14 is then toweled onto the area of building sheathing 10 using the straight edge 22 of a trowel 20 to apply a layer 14' in FIG. 2, of the fluid mixture 14 onto the area 10, the straight edge 22 of the trowel rolling over the rigid beads 16 as if they were ball bearings, to leaving fluid mixture 14 between the beads 16 and for creating the layer 14' to have a substantially uniform thickness T on the building sheathing 10 as shown in FIG. 2, that is substantially equal to the diameter of the beads 16, e.g. 1.5 mm.

Before the layer 14' of fluid mixture 14 that has been applied to the area of building sheathing 10 has set, dried, hardened or cured, the substantially vertically extending peak portions or peaks 32 of an inner surface of an expanded foam insulation board 30 (e.g. EPS board) are pressed into the still fluid layer 14' for adhering the board 30 to the area of building sheathing 10. The inner surface of the expanded foam insulation board 30 has valleys 34 between the peaks 32 with a distance D between the peaks 32 and valleys 34 as shown in FIG. 3 that are greater, actually much greater, then twice the diameter of the beads (T). For example distance D can be 1 to 10 cm.

The layer of fluid mixture 14, 14' is allowed to set, harden or dry to fix the board 30 to the area of building sheathing 10 with spaces vertical or channels being left between the liquid barrier 14' and the valleys 34 for substantially vertical water runoff by the action of gravity, across the area of building sheathing 10 behind the EPS board 30.

The amount of time to put the EPS board in place depends on the weather conditions. One needs to place the EPS board 30 on the membrane 14 before it skins over and so no waiting period is actually needed before placing the EPS board.

Typical proportions of ingredients and additives of the caulking polymer mixture (e.g. RHOPLEX™ 928, a highsolids acrylic copolymer emulsion caulking from The Dow Chemical Company) and glass beads (e.g. 1.5 mm glass beads from AGSCO Corporation of Hasbrouck Heights, N.J.) are all approximate and in percent by weight as follows:

a. acrylic copolymer emulsion—from 65-80, preferably from 70-76;

b. glass beads 22—diameter about 1 mm to about 3 mm, preferably from 1.2 mm to 2.3 mm and amount from 3-6, preferably from 4-5;

c. sand (e.g. 0.2 mm powder)—from 13-18, preferably from 15-16;

d. BERMACOLL brand cellulose ether (ethyl hydroxy ethyl cellulose) as a thickener—from 1-3, preferably from 2-2.5;

e. pigments (e.g. light green to act as a trademark identifier of the source of the barrier)—from 0.05-0.15, preferably from 0.08-0.12;

f. surfactant (e.g. benzyl alcohol)—from 1.6-2.6, preferably from 1.8-2.2;

g. $TiO_2$ to make the barrier opaque—from 0.6-1.3, preferably from 0.9-1.1;

h. water—from 2-5, preferably from 3-4; and i. ammonia to control pH to be near neutral—about 0.03 to 0.07.

The caulking mixture of the invention has a viscosity range of about 60 to 85, or preferably about 70 to 75 using number 1 spindles at the 0.05 setting.

In even greater detail, using the premixed, water based acrylic co-polymer self gauging trowel on composition of the invention, the weather barrier membrane 14 can be applied by troweling onto a wide variety of sheathing 10, including but not limited to USG Secure Rock sheet rock, Fiber faced Gyp sheathing, exterior Gypsum sheathing, and sound unpainted exterior grade wood based sheathing such as plywood and non-veneer boards. All joints must be reinforced with a 4" wide strip of ENERMITE™ 4.5 mesh 18 or equivalent.

Drying time depends upon the air temperature relative humidity and the porosity of the sheathing. Under average drying conditions (70 F, 55% R.H.), the barrier of the invention sets within 3 hours and achieves full cure in approximately seven days. The work should be protected from rain for at least 12 hours.

After applying the barrier 14 to a substrate 10, the insulation board 30 should be immediately attached to the substrate, by pressing its corrugation ridges 32 into the applied barrier layer 14', making sure the barrier does not skin over before applying the EPS board 30.

The barrier 14' does not create a water vapor barrier when installed according to application instructions but is a proper weather or liquid barrier that still allowed the sheathing to "breath."

The barrier 14' will accommodate reasonable movement of wood based sheathing due to expansion and contraction without reduction of its bond to the sheathing or the bond of the EPS board 30 to the barrier 14'.

Surfaces shall not be below 45 F or painted and must be clean, dry, structurally sound and free of grease or oil. American Plywood Association guidelines must be followed to insure proper installation of the wood based sheathing. Temperature for application of the barrier 14 must be 45 F or higher and must remain so for a minimum of 48 hours. No mixing is required and additional water should not be added.

The barrier 14' should be applied directly to the substrate using the stainless steel trowel 20. The integrated beads 16 automatically gauge the coating thickness T as mentioned above. By trowel, tape mesh 18 to the joints 12 and upon completion of joint taping, skim (using the barrier material 14 of the invention as a gauge) the entire substrate field or area, making sure there are no voids or thin areas on the surface area. The composition 14 of the invention is tinted green to help with this process. While the barrier 14, is wet place the inner-surface corrugated EPS foam board 30 into the coating in a running bond pattern. Allow about three hours of cure time before rasping the foam boards.

For the best adhesion of the EPS board 30 to the sheathing 10 the peak portions 32 of the inner surface of the expanded foam insulation board 30 is presses and worked into the still fluid layer 14 sufficiently to push a plurality of the beads aside (see the arrows in FIG. 3) so that the peak portions are closer to the building sheathing then the diameter of the beads T to better adhere the board 30 to the sheathing 10. As noted, the distance D between the peaks and valleys is greater then twice the diameter of the beads and in fact much greater then this two time 1.5 mm amount, for example, and may be about 1 to 2 inches (or about 2.5 to about 5 cm) or more.

The trowel 20 and another tools used can be cleaned with water while the composition of the invention is still wet.

While a specific embodiment of the invention has been shown and described in detail to illustrate the application of the principles of the invention, it will be understood that the invention may be embodied otherwise without departing from such principles.

What is claimed is:

1. A wall system method for creating a liquid barrier from about 1 mm to about 3 mm thick with insulation over an area of building sheathing (10) having at least one joint (12), comprising:

providing a supply of fluid caulking polymer mixture (14) containing a dispersion of spherical, rigid, non-reactive beads (16) of a substantially uniform diameter (T), the diameter of the beads (16) being selected to correspond to the thickness (T) of a liquid barrier to be applied to the area of building sheathing;

wherein the fluid caulking polymer mixture contains, in percent by weight, 3-6 percent beads of diameter (T);

wherein the diameter of the beads (T), and the corresponding thickness of the liquid barrier (T), is from about 1 mm to about 3 mm;

affixing a mesh (18) across each joint (12) in the area of building sheathing (10);

troweling the fluid caulking polymer mixture (14) onto the area of building sheathing (10) using a trowel (20) to apply a layer (14') of the fluid mixture onto the area (10), spreading the fluid caulking polymer mixture (14) by applying pressure with the trowel (20) both towards the building sheathing (10) and substantially parallel to the building sheathing (20), the beads (16) limiting the movement of the trowel (20) towards the building sheathing (20), the trowel (20) rolling over the rigid beads (16) and leaving fluid mixture (14) between the beads (16) for creating the layer (14') to have a substantially uniform thickness (T) on the building sheathing that is substantially equal to the diameter of the beads (16);

before the layer of fluid mixture that has been applied to the area of building sheathing has dried, pressing peak portions (32) of an inner surface of an expanded foam insulation board (30) into the layer (14') sufficiently to push a plurality of the beads away from a location between the peak portions and the sheathing, so that the peak portions are closer to the sheathing then the diameter of the beads, for adhering the board (30) to the area of building sheathing (10), the inner surface of the expanded foam insulation board (30) having valleys (34)

between the peaks (32) with a distance (D) between the peaks (32) and valleys (34) being greater then twice the diameter of the beads (T) to leave channels for liquid flow between the barrier and the sheathing; and allowing the layer of fluid mixture to set to create the liquid barrier (14') and for fixing the board (30) to the area of building sheathing (30) with spaces (S) being left between the liquid barrier and the valleys (34) for water runoff across the area of building sheathing (10).

2. The method of claim 1, wherein the caulking polymer is acrylic copolymer emulsion, the beads are glass beads having a diameter of about 1 mm to about 3 mm.

3. The method of claim 1, wherein the caulking polymer is acrylic copolymer emulsion, the beads are glass beads having a diameter of about 1 mm to about 3 mm, and the mixture includes sand, thickener, pigment, and water.

4. The method of claim 1, wherein the caulking polymer is acrylic copolymer emulsion, the beads are glass beads having a diameter of about 1 mm to about 3 mm, and the mixture includes sand, water, thickener, surfactant, pigment, and TiO2 in an amount sufficient to make the barrier opaque.

5. The method of claim 1, wherein the caulking polymer is a copolymer emulsion, the beads have a diameter of about 1 mm to about 3 mm, and the mixture includes sand, water, thickener, surfactant, pigment, TiO2 in an amount sufficient to make the barrier opaque, and ammonia in an amount sufficient to control pH of the mixture.

6. The method of claim 1, including using the polymer mixture as adhesive for affixing the mesh (18) across each joint (12).

7. The method of claim 1, wherein the caulking polymer is a copolymer emulsion, the beads have a diameter of about 1 mm to about 3 mm, and the mixture includes sand, water, thickener, surfactant, pigment, $TiO_2$ in an amount sufficient to make the barrier opaque, and ammonia in an amount sufficient to control pH of the mixture, the mixture containing, in weight percent, about 65-80 copolymer emulsion, about 3-6 beads, about 13-18 sand, about 2-5 water, about 1-3 thickener, about 1.6-2.6 surfactant, about 0.05-0.15 pigment 11, and about 0.6-1.3 $TiO_2$.

8. A method for creating a liquid barrier with insulation on a building sheathing comprising: providing a polymer mixture containing a dispersion of rigid spherical beads of uniform diameter; affixing a mesh across joints in the sheathing; troweling the mixture onto the sheathing using a straight edge of a trowel, the beads in the mixture holding the trowel a substantially uniform distance away from the building sheathing during polymer mixture spreading, the straight edge rolling over beads in the mixture for leaving mixture between the beads to create a layer having a uniform thickness substantially equal to the diameter of the beads on the sheathing; and, before the layer set, pressing peaks of an inner corrugated surface of an insulation board into the layer for adhering the board to the sheathing, the inner surface having valleys between the peaks at a distance from the peaks that is greater then twice the diameter of the beads; the layer setting to create the liquid barrier and for fixing the board to the sheathing with spaces left between the barrier and the valleys for water runoff across the sheathing.

9. The method of claim 8, wherein the caulking polymer is acrylic copolymer emulsion, and the beads are glass beads having a diameter of about 1 mm to about 3 mm.

10. The method of claim 8, wherein the caulking polymer is acrylic copolymer emulsion, the beads are glass beads having a diameter of about 1 mm to about 3 mm, and including in the mixture a thickener, a color pigment, a surfactant and water.

11. The method of claim 8, wherein the caulking polymer is acrylic copolymer emulsion, the beads are glass beads having a diameter of about 1 mm to about 3 mm, and including in the mixture a thickener, a color pigment, $TiO_2$ in an amount sufficient to make the barrier opaque and water.

12. The method of claim 8, wherein the caulking polymer is a copolymer emulsion, the beads have a diameter of about 1 mm to about 3 mm, and the mixture includes sand, water, thickener, surfactant, pigment, $TiO_2$ in an amount sufficient to make the barrier opaque, and ammonia in an amount sufficient to control pH of the mixture.

13. The method of claim 8, including the pressing peak portions of the inner surface of the expanded foam insulation board into the layer sufficiently to push a plurality of the beads away from a location between the peak portions and the sheathing, for better adhering the board to the area of building sheathing.

14. The method of claim 8, including using the polymer mixture as adhesive to affixing the mesh (18) across each joint (12).

15. The method of claim 8, wherein the caulking polymer is a copolymer emulsion, the beads have a diameter of about 1 mm to about 3 mm, and the mixture including sand, water, thickener, surfactant, pigment, $TiO_2$ in an amount sufficient to make the barrier opaque and ammonia in an amount sufficient to control pH of the mixture, the mixture containing, in weight percent, about 65-80 copolymer emulsion, about 3-6 beads, about 13-18 sand, about 2-5 water, about 1-3 thickener, about 1.6-2.6 surfactant, about 0.05-0.15 pigment and about 0.6-1.3 $TiO_2$.

16. The method of claim 1, wherein the fluid caulking polymer mixture contains, in percent by weight, 4-5 percent beads, the beads having a substantially uniform diameter (T) from about 1 mm to about 3 mm.

17. The method of claim 1, wherein the fluid caulking polymer mixture contains, in percent by weight, 3-6 percent beads, the beads having a substantially uniform diameter (T) from about 1.2 mm to about 2.3 mm.

18. The method of claim 1, wherein the insulation board is pressed into the layer (14') of the fluid caulking polymer mixture (14) immediately after the layer is applied.

* * * * *